US009960538B2

(12) United States Patent
Nagasaki et al.

(10) Patent No.: US 9,960,538 B2
(45) Date of Patent: May 1, 2018

(54) CONNECTOR ASSEMBLY

(71) Applicant: Tyco Electronics Japan G.K., Kanagawa (JP)

(72) Inventors: Taisuke Nagasaki, Kanagawa (JP); Shinji Yamada, Kanagawa (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 34 days.

(21) Appl. No.: 14/838,496

(22) Filed: Aug. 28, 2015

(65) Prior Publication Data

US 2016/0064862 A1 Mar. 3, 2016

(30) Foreign Application Priority Data

Aug. 28, 2014 (JP) ..... 2014-173694

(51) Int. Cl.
*H01R 4/50* (2006.01)
*H01R 13/639* (2006.01)

(52) U.S. Cl.
CPC ..... *H01R 13/639* (2013.01)

(58) Field of Classification Search
CPC ..... H01R 13/6275; H01R 13/62933; H01R 23/7005
USPC ..... 439/345, 953, 378, 372
See application file for complete search history.

(56) References Cited

U.S. PATENT DOCUMENTS 6,257,925 B1 * 7/2001 Jones ..... H01R 12/7023 439/357
7,467,965 B1 * 12/2008 Arai ..... H01R 13/6273 439/353
7,588,459 B2 * 9/2009 Sugii ..... H01R 13/743 343/715

FOREIGN PATENT DOCUMENTS

| | | | |
|---|---|---|---|
| JP | 59149389 | U | 10/1984 |
| JP | 429182 | U | 3/1992 |
| JP | 4115777 | U | 10/1992 |
| JP | 589925 | A | 4/1993 |
| JP | 2002198126 | A | 7/2002 |
| JP | 2003208945 | A | 7/2003 |
| JP | 2005285333 | A | 10/2005 |
| JP | 2010257725 | A | 11/2010 |

OTHER PUBLICATIONS

Japanese Office Action, dated Dec. 7, 2017, 3 pages.

* cited by examiner

*Primary Examiner* — Phuong Chi T Nguyen
(74) *Attorney, Agent, or Firm* — Barley Snyder

(57) ABSTRACT

A connector assembly is provided and includes receptacle connector and a header connector. The receptacle connector includes a connector housing with a receptacle contact, a fastener, and a lock. The fastener includes a fastening section fixed at an outer end portion thereof. The lock attaches to the connector housing and is movable along a length thereof. The header connector is engageable with the receptacle connector and includes a header contact that is connectable with the receptacle contact, a header housing, and an elastic fastener. The header housing has an engagement portion to which the header contact is attached and that engages the connector housing, and the elastic fastener extends outward from the engagement portion of the header housing.

8 Claims, 12 Drawing Sheets

CONNECTOR ASSEMBLY

CROSS-REFERENCE TO RELATED APPLICATIONS

This application claims the benefit of the filing date under 35 U.S.C. § 119(a)-(d) of Japanese Patent Application No. 2014-173694 filed Aug. 28, 2014.

FIELD OF THE INVENTION

The invention relates to a connector assembly and, more particularly, to a connector assembly having a receptacle connector and a header connector.

BACKGROUND

Header connectors for supplying external electrical power to a motor such as a servo motor are well-known, with the header connector engaging a receptacle connector that is connected to cable, and power being supplied to the motor accordingly.

A push-twist style locking mechanism has generally been used to secure the header connector and the receptacle connector. One well-known example of a lock and release device for connectors employing the push-twist style locking mechanism is described in Japanese Patent Application JP2003-208945A, for example.

As shown in JP2003-208945A, a cam groove is formed along an outer circumferential surface of a header housing of a header connector. A receptacle connecter includes a receptacle housing that engages with the header housing and a coupling rotating member that surrounds the receptacle housing so as to be rotatable with respect to the receptacle housing. Further, a coil spring is wound on the receptacle housing. One end of the coil spring is fixed to an outer circumferential portion of the receptacle housing, and the other end of the coil spring is fixed to an inner circumferential portion of the coupling rotating member.

In addition, when the receptacle connector is engaged with the header connector, a protrusion provided on an internal circumferential surface at one end surface side of the coupling rotating member enters the cam groove on the header connector side. Then, due to the biasing coil spring, the protrusion on the receptacle connector side is locked with the cam groove on the header connector, thereby locking the two connectors so that they do not come apart.

To separate the receptacle connector from the header connector, it is sufficient to rotate the coupling rotating member against the biasing force of the coil spring to pull the protrusion on the receptacle connector side out of the cam groove on the header connector side.

In summary, the locking of the receptacle connector to the header connector can be easily performed by simply pressing the protrusion on the coupling rotating member into the cam groove on the header connector side. Moreover, to release the lock, it is sufficient to simply rotate the coupling rotating member against the biasing force of the coil spring. Thus, the operation to release the lock can be easily performed.

However, in the lock and release device of the connector described in JP2003-208945A of the related art had the following problems.

Specifically, with the lock and release device of the connector described in JP2003-208945A, the cam groove is formed in the header housing. However, it is necessary to provide a coil spring that has a length in the engagement direction on the receptacle connector side. Hence, the lock and release device of the known connector has a problem in that it was not possible to shorten the engagement direction height of the two connectors.

SUMMARY

Thus, the present invention was conceived to solve the above-described problem, among other. Accordingly, a connector assembly according to the invention is provided and includes receptacle connector and a header connector. The receptacle connector includes a connector housing with a receptacle contact, a fastener, and a lock. The fastener includes a fastening section fixed at an outer end portion thereof. The lock attaches to the connector housing and is movable along a length thereof. The header connector is engageable with the receptacle connector and includes a header contact that is connectable with the receptacle contact, a header housing, and an elastic fastener. The header housing has an engagement portion to which the header contact is attached and that engages the connector housing, and the elastic fastener extends outward from the engagement portion of the header housing.

BRIEF DESCRIPTION OF THE DRAWINGS

The above and other features and advantages of the invention will become more apparent by describing in detail exemplary embodiments thereof with reference to the accompanying drawings, in which.

DETAILED DESCRIPTION OF THE EMBODIMENT(S)

The following describes embodiments of the present invention with reference to the drawings.

Figure 1:
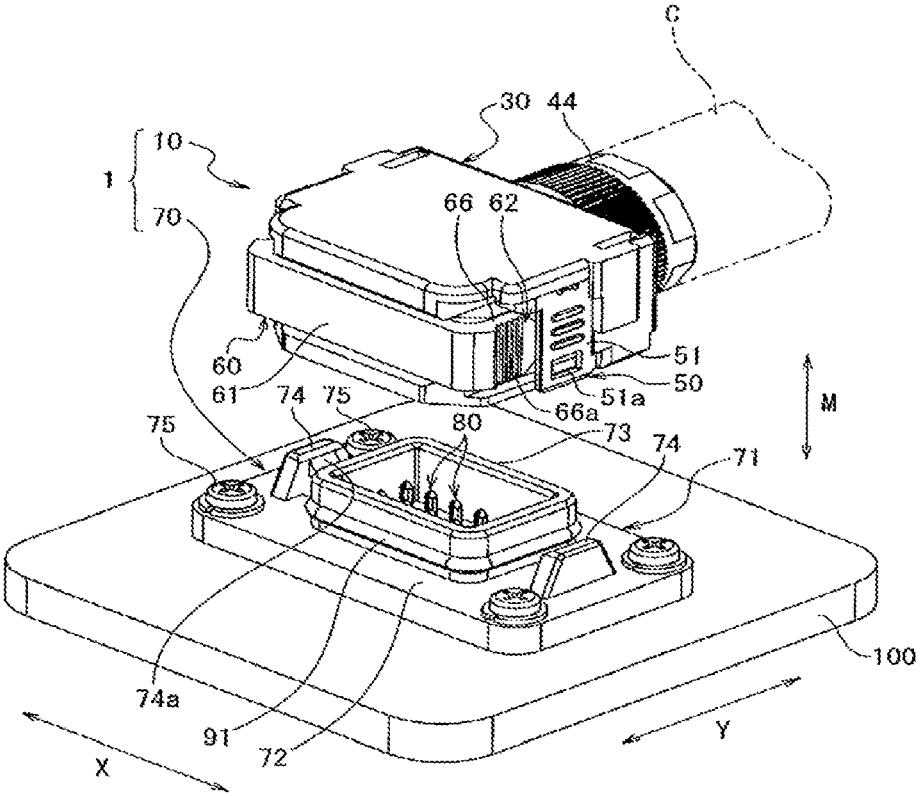
FIG. 1 is a perspective view of a connector assembly according to the invention.
Figure 2:
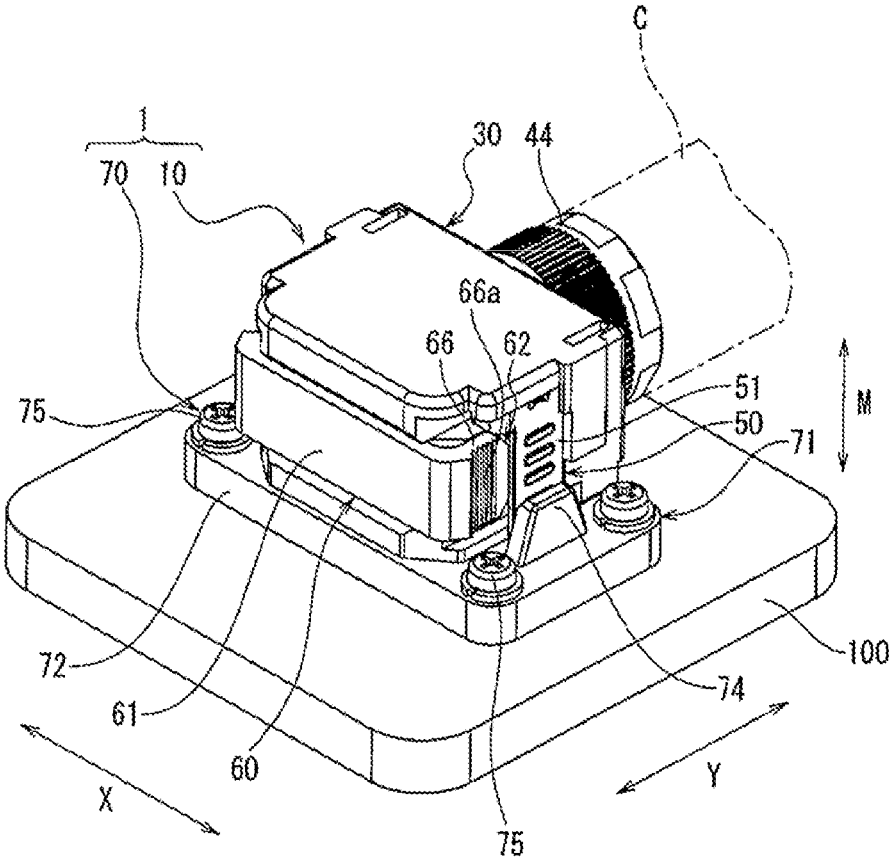
FIG. 2 is a perspective view of the connector assembly of FIG. 1 showing a receptacle connector engaged with a header connector.

With reference to FIG. 1, a connector assembly 1 is shown with a receptacle connector 10 and a header connector 70. The receptacle connector 10 includes a lock 60 in a second position being engaged with a header connector 70.

Here, the connector assembly 1 includes the receptacle connector 10 that is connected to an end of a cable C and the header connector 70 that engages with the receptacle connector 10.

The receptacle connector 10 includes a connector housing 20, a pair of fasteners 50, and a lock 60.

Figure 5A:
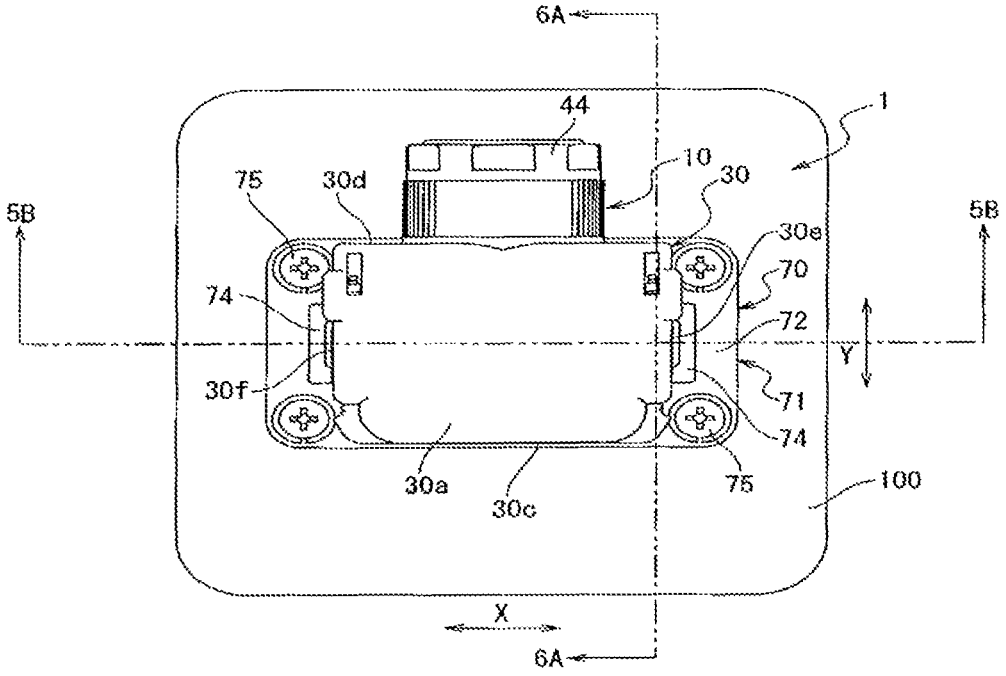
FIG. 5A is a top plan view of a connector assembly according to the invention.
Figure 5B:
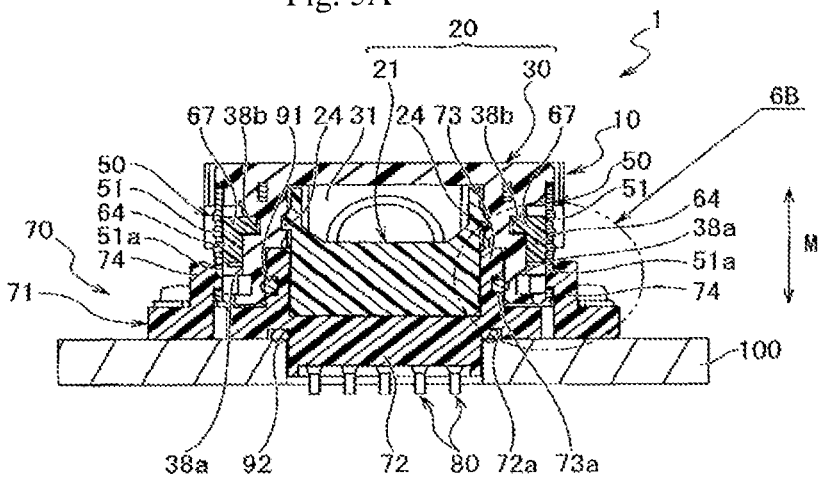
FIG. 5B is a cross-sectional view of the connector assembly of FIG. 5A taken along line 5B-5B.
Figure 8A:
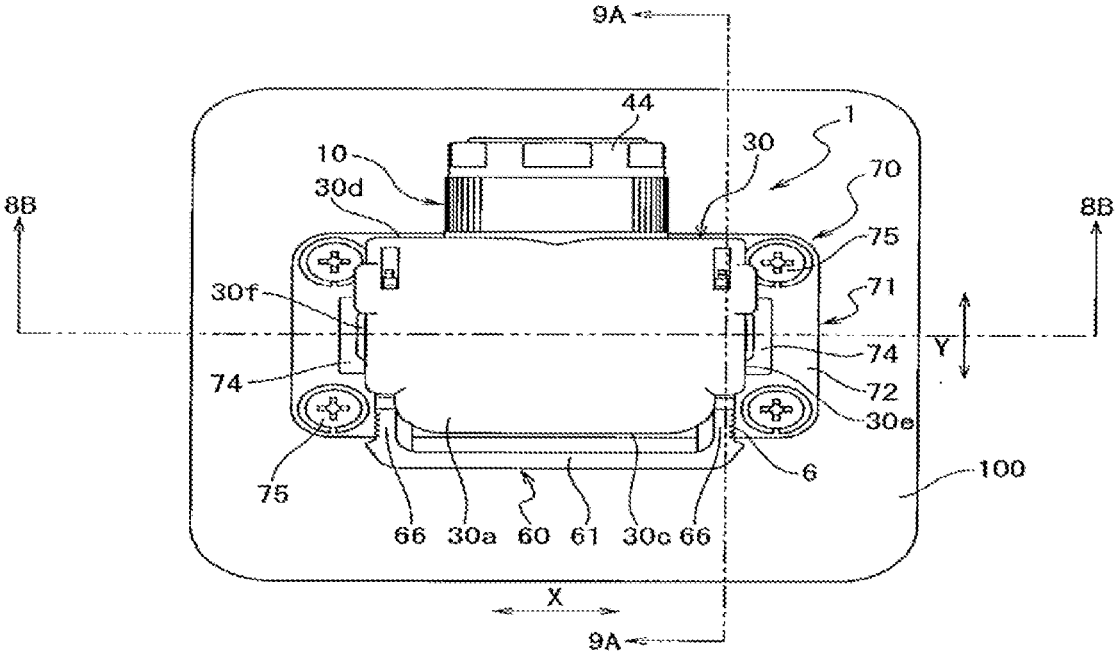
FIG. 8A is a top plan view of a connector assembly according to the invention.
Figure 8B:
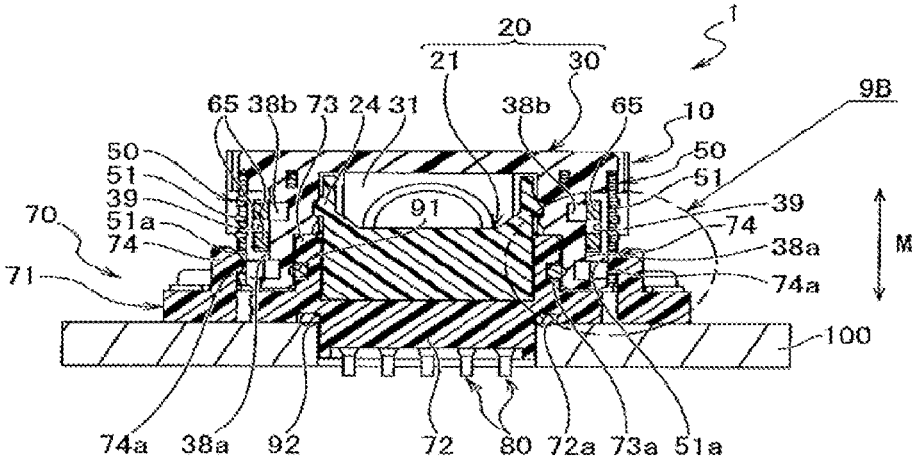
FIG. 8B is a cross-sectional view of a connector assembly of FIG. 8A taken along line 8B-8B.
Figure 11:
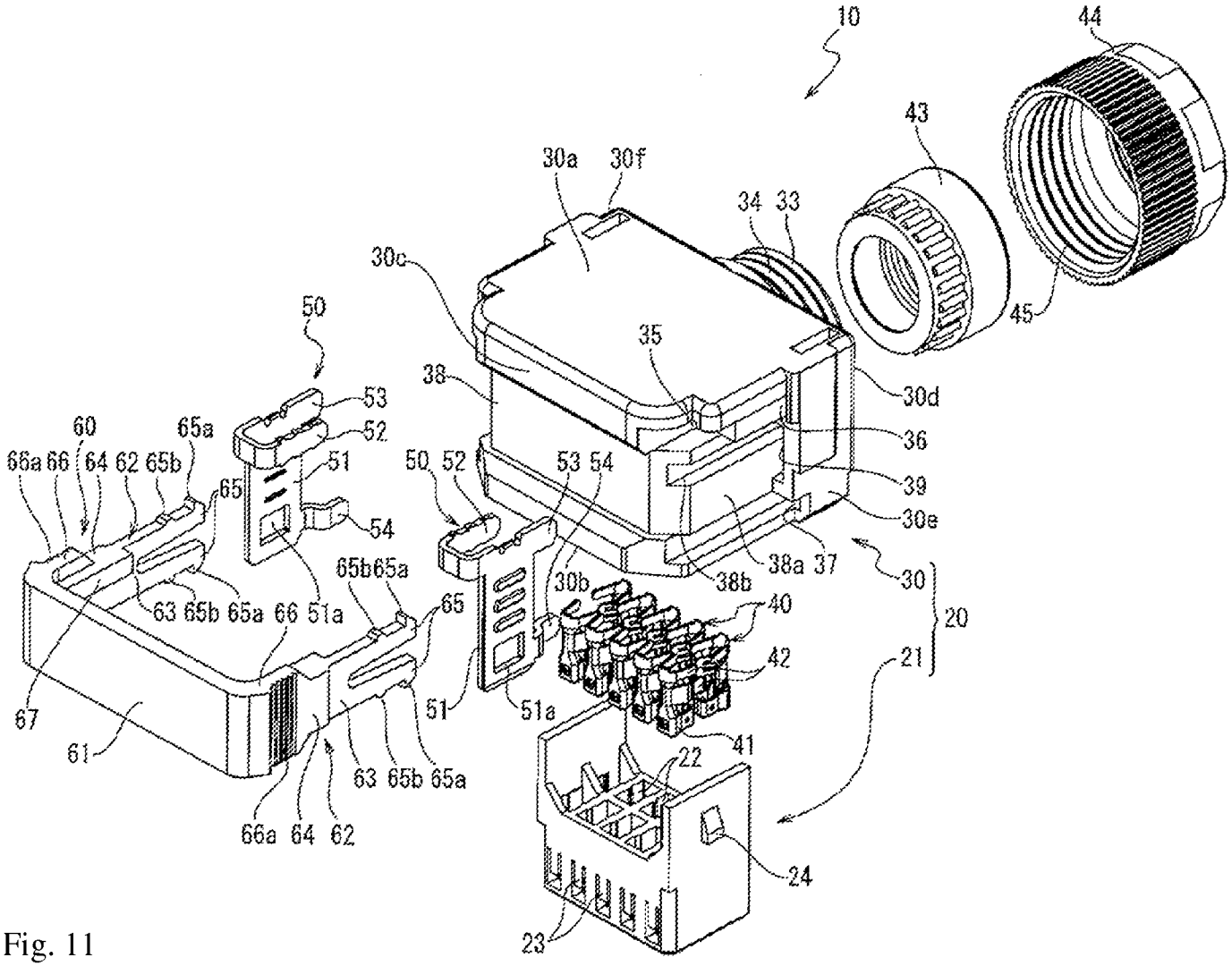
FIG. 11 is an exploded perspective view of a receptacle connector of a connector assembly according to the invention.

As shown in FIG. 5B, FIG. 8B, and FIG. 11, the connector housing 20 includes a contact housing 21 and a base housing 30 that houses the contact housing 21.

The contact housing 21 is formed to have a substantially cuboid form as shown in FIG. 11 with a plurality (10 in the present embodiment) of contact housing chambers 22 formed in two rows. The contact housing 21 is formed by molding a synthetic resin. Each contact housing chamber 22 of the contact housing 21 is provided with a housing lance 23 for locking with the corresponding receptacle contact 40. Further, a pair of locking protrusions 24 are provided on the two sidewalls of the contact housing 21 and used to lock the contact housing 21 to the base housing 30 when the contact housing 21 is inserted into the base housing 30.

Each contact housing chamber 22 receives the receptacle contact 40, which is connected to an electrical wire (not shown in the drawings) of the cable C. As shown in FIG. 11, each receptacle contact 40 includes a box-like receptacle portion 41 and a barrel portion 42 having a core wire barrel and an insulation barrel. Each receptacle contact 40 is formed by stamping and forming an electrically conductive metal sheet. Each electrical wire is connected by crimping to the barrel portion 42 of the corresponding receptacle contact 40. When the receptacle contact 40 connected to the corresponding electrical wire is inserted into the contact housing chamber 22, the receptacle contact 40 is locked by the housing lance 23 provided in the contact housing chamber 22.

Figure 7A:
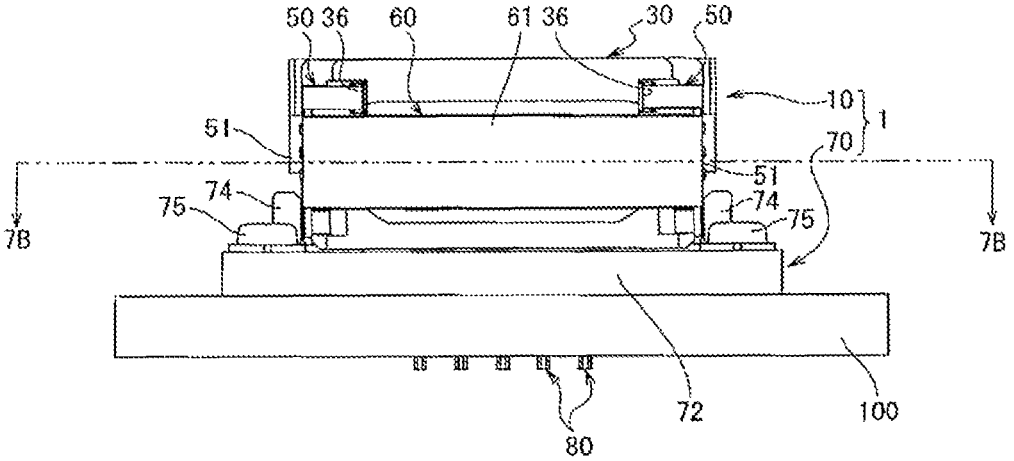
FIG. 7A is a front view of the connector assembly of FIG. 5A.
Figure 7B:
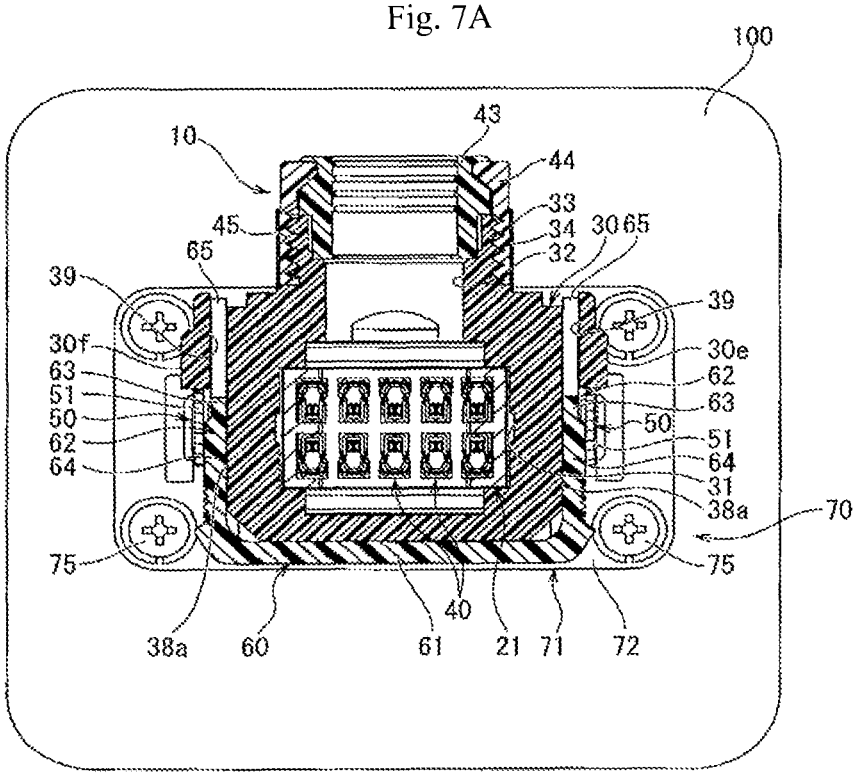
FIG. 7B is a cross-sectional view of the connector assembly of FIG. 7A taken along line 7B-7B.

Further, as shown in FIG. 5A, FIG. 5B, and FIG. 11, the base housing 30 has a substantially cuboid form that extends in an engagement direction indicated by arrow M, in a lateral direction, indicated by arrow X, that is perpendicular to the engagement direction, and in a front-back direction, indicated by arrow Y, that is perpendicular to the engagement direction and the lateral direction. The base housing 30 includes a top surface 30*a*, a bottom surface 30*b*, a front surface 30*c*, a back surface 30*d*, a right side surface 30*e* and a left side surface 30*f*, and is formed by molding a synthetic resin. As shown in FIG. 5B and FIG. 7B, the base housing 30 is formed with a contact receiving space 31. The contact receiving space 31 has an opening along bottom surface of the base housing 30 (bottom surface of FIG. 5B), and extends upwards along the engagement direction of the base housing 30.

Figure 10A:
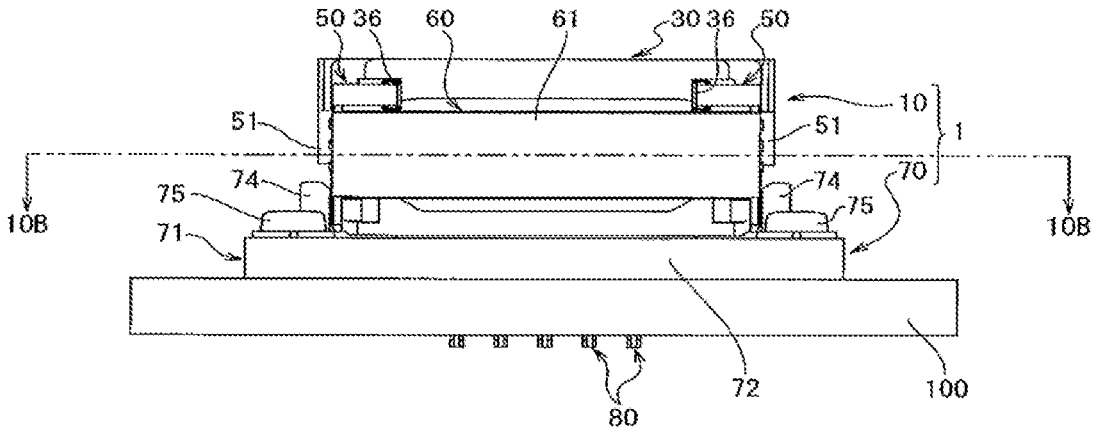
FIG. 10A is a front view of the connector assembly of FIG. 8A.
Figure 10B:
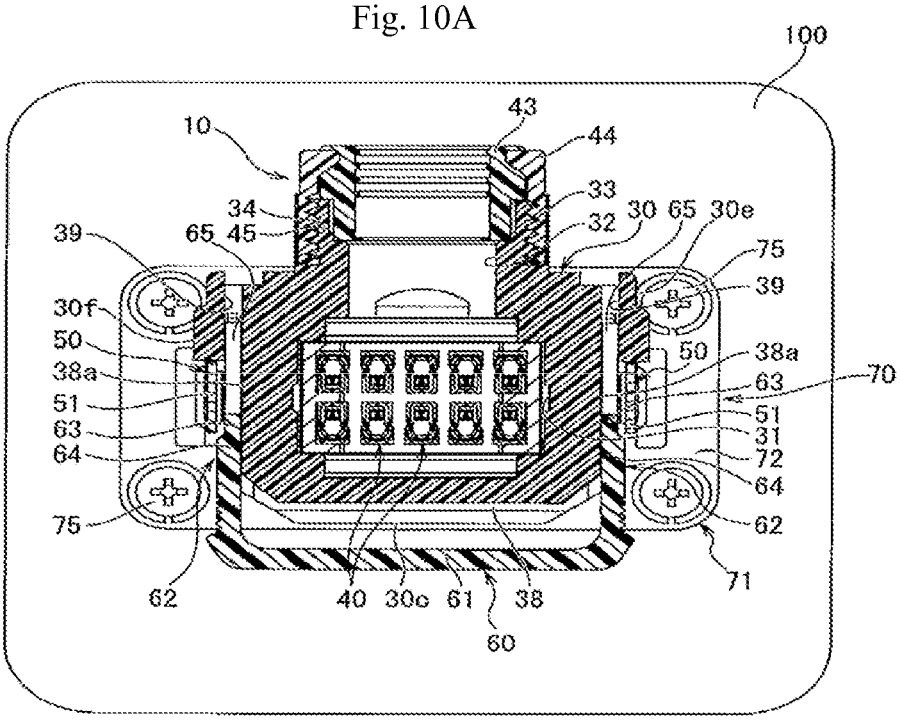
FIG. 10B is a cross-sectional of the connector assembly of FIG. 10A taken along line 10B-10B.

As shown in FIG. 10B and FIG. 11, the base housing 30 is provided with a U-shaped, lock receiving recess 38 formed to provide a recess in the front surface 30*c*, the right side surface 30*e* and the left side surface 30*f*. As shown in FIG. 10B, a pair of through-holes 39 is provided along the left-side end portion and the right-side end portion of the lock receiving recess 38, so as to extend from both end portions of the lock receiving recess 38. Further, a pair of first fastener receiving through-holes 35 is formed along an upper portion on both the left and right end sides of the front surface 30*c* of the base housing 30. Further, at an upper side of the through-holes 39 on the sides of the right side surface 30*e* and the left side surface 30*f* of the base housing 30, a pair of second fastener receiving through-holes 36 is formed. In addition, a pair of third fastener receiving through-holes 37 is formed along a lower side of the through-holes 39 on the sides of the right side surface 30*e* and the left side surface 30*f* of the base housing 30. Later-described first fastening members 52 of the fasteners 50 are press-fitted in the first fastener receiving through-holes 35, second fastening members 53 of the fasteners 50 are secured in the second fastener receiving through-holes 36, and third fastening members 54 of the fasteners 50 are fixed in the third fastener receiving through-holes 37.

As shown in FIG. 10B, a cable receiving passageway 32 for inserting the cable C (see FIG. 1) is formed at a back wall of the base housing 30, and a cylindrical portion 33 surrounding the cable receiving passageway 32 is formed protruding backwards. Also, a threaded portion 34 is formed on the outer circumference of the cylindrical portion 33. In addition, as shown in FIG. 10B and FIG. 11, a small-diameter portion of cylindrical water-resistant rubber seal 43 having a large-diameter portion and a small-diameter portion is inserted on the inner circumferential side of the cylindrical portion 33. A threaded portion 45 of a water-resistant rubber seal pressing member 44 is screwed onto the threaded portion 34 on the outer circumferential side of the cylindrical portion 33. An inner diameter of the water-resistant rubber seal 43 is approximately the same as the diameter of the cable receiving passageway 32. To attach the cable C, a leading end of the cable C, which is not shown in the drawing, is inserted through an inner side through-hole of the water-resistant rubber seal 43 so as to be positioned within the cable receiving passageway 32. Then, by screwing the water-resistant rubber seal pressing member 44 onto the cylindrical portion 33, the water-resistant rubber seal 43 is caused to press hard on the cable C from the outer circumferential side of the cable C. As a result, the space between the water-resistant rubber seal 43 and the cable C is sealed.

Further, as shown in FIG. 1, FIG. 5B, and FIG. 11, the pair of fasteners 50 is arranged along the two outer end portions of the base housing 30 in the lateral direction, which is indicated by the arrow X and perpendicular to the engagement direction. As shown in FIG. 11, each of the fasteners 50 includes a fastening section 51 having a rectangular plate shape that extends in the engagement direction, and is formed by stamping and forming a metal sheet. A fastener receiving opening 51*a* that locks with a later-described elastic fastener 74 is formed along a lower side in the engagement direction of the fastening section 51. In addition, a first fastening member 52 to be press-fitted into the first fastener receiving through-hole 35 of the base housing 30 is provided along an upper front edge of the fastening section 51. The first fastening member 52 is formed to first extend forward from an upper front edge of the fastening section 51, then extend inward in the lateral direction, before finally extending backwards. Further, an upper back edge of the fastening section 51 is provided with a second fastening member 53 to be secured in the second fastener receiving through-hole 36 of the base housing 30. The second fastening member 53 extends backwards from the upper back edge of the fastening section 51. In addition, a lower back edge of the fastening section 51 is provided with the third fastening member 54 to be secured in the third fastener receiving through-hole 37 of the base housing 30. The third fastening member 54 first extends backwards and inward in the lateral direction from the lower back edge of the fastening section 51, and then extends backward.

As shown in FIG. 10B, when the fasteners 50 are secured to the base housing 30, the fastening sections 51 are secured and separated by a predetermined gap from the outer surface 38*a* of the base housing 30. Here, the outer surface 38*a* of the base housing 30 is a bottom surface on the left side surface 30*f* side and the right side surface 30*e* side of the lock receiving recess 38.

Further, as shown in FIG. 1 to FIG. 12 the lock 60 is attached to the base housing 30. The lock 60 is attached to the base housing 30 so as to be movable between the first position and the second position in a front-back direction, indicated by arrow Y, that is perpendicular to both the engagement direction, indicated by the arrow M, and the lateral direction, indicated by the arrow X. As shown in FIG. 3, FIG. 4 and FIGS. 8 to 10, when the lock 60 is in the first position, a later-described connecting plate portion 61 of the lock 60 protrudes forward from the lock receiving recess 38 of the base housing 30. Further, as shown in FIG. 1, FIG. 2 and FIGS. 5 to 7, when the lock 60 is in the second position, the later-described connecting plate portion 61 of the lock 60 is housed within the lock receiving recess 38 of the base housing 30.

Thus, the lock 60, when in the first position, puts the fastener 50 in an unsupported state, and when in the second position, supports the fastener 50 on the inner side of the fastening section 51 of the fastener 50.

In other words, when the lock 60 is moved from a front side to a back side, it is configured to move from the first position to the second position. Further, the lock 60 includes a connecting plate portion 61 that extends in the lateral direction. The lock 60 includes a pair of support plate portions 62 at both outer end portions in the lateral direction of the connecting plate portion 61, and is integrally formed by molding a synthetic resin. Further, each support plate portion 62 extends backwards via a later-described grip portion 66 from outer end portions in the lateral direction of the connecting plate portion 61, and enters between an outer surface 38*a* of the base housing 30 and an inner surface 51*b* (see FIG. 6B and FIG. 9B) of the fastener 50. Also, as shown in FIG. 9B and FIG. 11, each support plate portion 62 includes a thin plate portion 63 along a back side thereof, which forms a predetermined gap with the inner surface 51*b* of the fastening section 51 when the support plate portion 62 is in the first position. When the lock 60 is in the first position, the predetermined gap is formed between the thin plate portion 63 and the inner surface 51*b* of the fastening section 51, thereby putting the fastener 50 in an unsupported state. Also, as shown in FIG. 6B and FIG. 11, each support plate portion 62 includes, at the front side of the thin plate portion 63, a thick plate portion 64 that contacts the inner surface 51*b* of the fastening section 51 to support the fastener 50 when the support plate portion 62 is in the second position. When the lock 60 is in the second position, the thick plate portion 64 contacts the inner surface 51*b* of the fastening section 51, thus supporting the fastener 50.

Figure 6A:
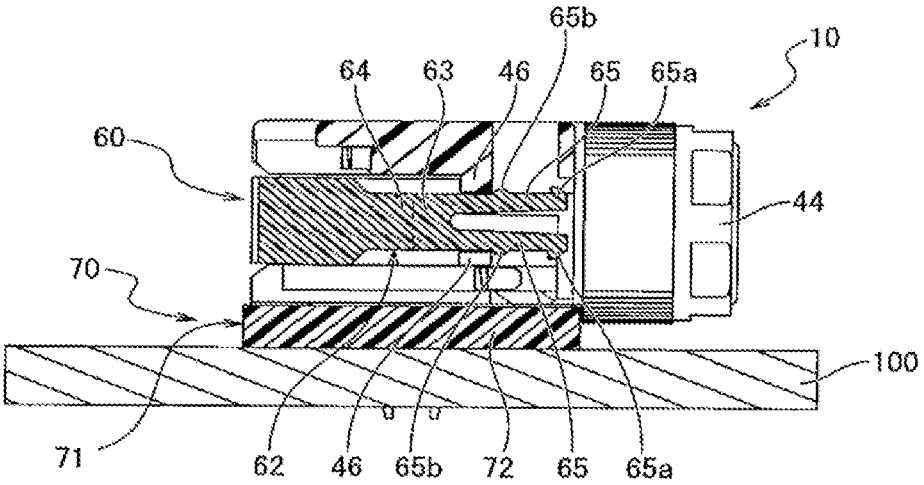
FIG. 6A is a cross-sectional view of the connector assembly of FIG. 5A taken along line 6A-6A.
Figure 6B:
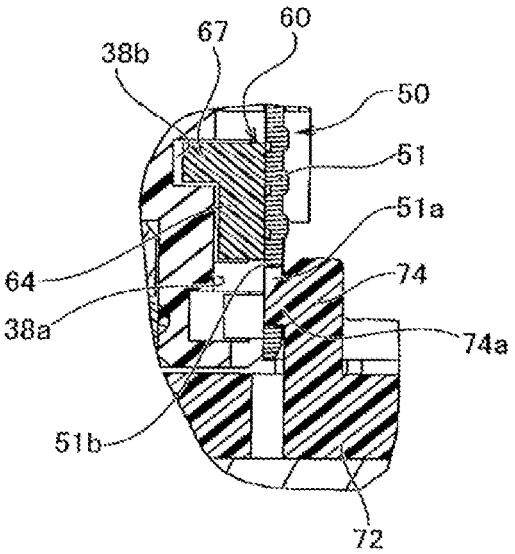
FIG. 6B is a close-up view of a portion indicated by the arrow 6B in FIG. 5B.
Figure 9A:
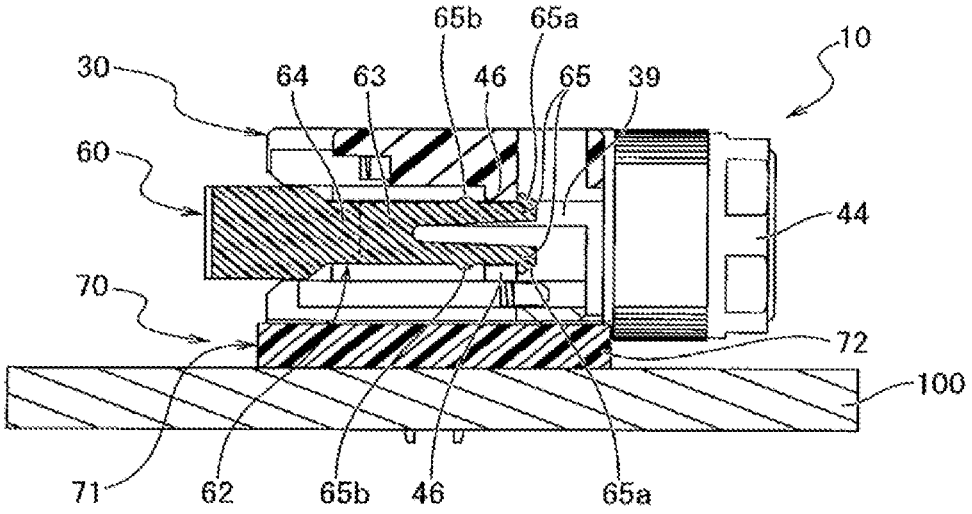
FIG. 9A is a cross-sectional view of a connector assembly of FIG. 8A taken along line 9A-9A.
Figure 9B:
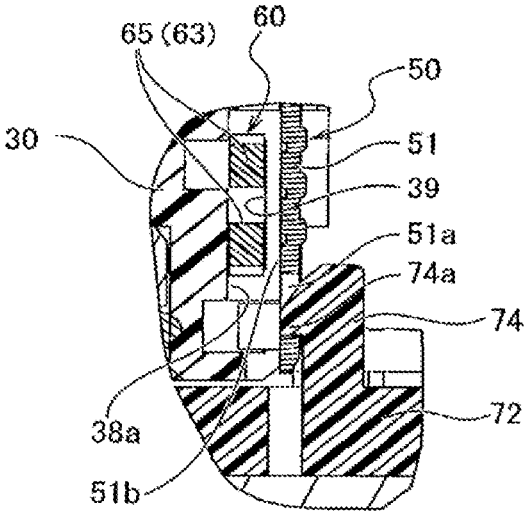
FIG. 9B is a close up view of a portion indicated by the arrow 9B in FIG. 8B.

In addition, as shown in FIG. 6A, FIG. 9A, and FIG. 11, the lock 60 includes a pair of upper and lower locking arms 65 that extend backwards from the thin plate portion 63. A first locking protrusion 65*a* is provided along a back edge of each locking arm 65, and a second locking protrusion 65*b* is provided with a predetermined separation from the first locking protrusion 65*a* to the front side of the first locking protrusion 65*a* of each locking arm 65. In addition, as shown in FIG. 9A, when a locking protrusion 46 of the base housing 30 is located between the first locking protrusion 65*a* and the second locking protrusion 65*b* of each locking arm 65, the lock 60 is in the first position. Further, as shown in FIG. 6A, when the locking protrusion 46 of the base housing 30 is located to the front side of second locking protrusion 65*b* of each locking arm 65, the lock 60 is in the second position.

Note also that, as shown in FIG. 5B and FIG. 11, the lock 60 includes a guide protrusion 67 on an inner side of the thick plate portion 64. As shown in FIG. 5B, the guide protrusion 67 enters into a guide groove 38*b* formed so as to extend in the front-back direction in the outer surface 38*a* of the base housing 30, to guide movement of the lock 60 in the front-back direction.

Further, as shown in FIG. 11, the lock 60 is provided with a left-right pair of grip portions 66 with serrations 66*a* formed on an outer surface thereof, between both outer end portions in the lateral direction of the connecting plate portion 61 and the pair of support plate portions 62.

Figure 12:
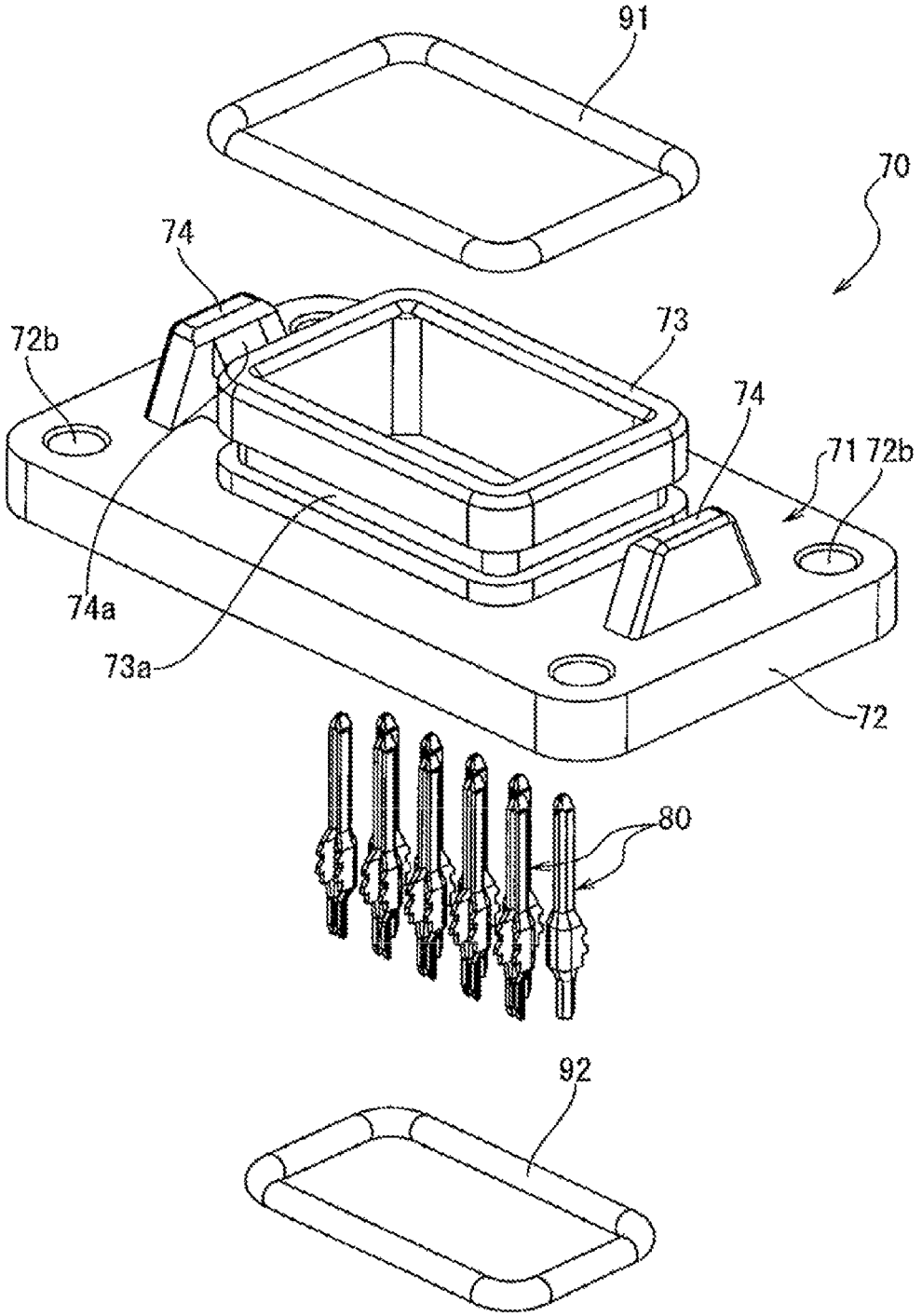
FIG. 12 is an exploded perspective view of a header connector of the connector assembly according to the invention.

The header connector 70, as shown in FIG. 1 and FIG. 12, includes a plurality (10 in the present embodiment) of header contacts 80 and a header housing 71 to which the header contacts 80 are attached.

Each header contact 80 is a male contact formed with a square-pin or tab shape, and is formed by stamping and forming an electrically conductive metal sheet. The plurality of header contacts 80 are received and contacted by receptacle portions 41 of the receptacle contact 40, which are not shown in the drawings, when the receptacle connector 10 is engaged with the header connector 70.

Further, the header housing 71 includes a rectangular plate-shaped housing base 72 that is attached to a motor casing 100 and is formed by molding a synthetic resin. As shown in FIG. 12, the housing base 72 has four fastener through-holes 72*b* formed at corners thereof. As shown in FIG. 1, the housing base 72 is attached to the motor casing 100 with four fastening screws 75. The housing base 72 has at central portion thereof the plurality of header contacts 80 arranged in two rows that extend along the lateral direction. Formed so as to protrude around the periphery of the plurality of header contacts 80 from the upper surface of the housing base 72 is an engagement portion 73. As shown in FIG. 5B and FIG. 8B, the engagement portion 73 engages on an inner side thereof with the contact housing 21 of the receptacle connector 10, and engages on an outer side thereof with the base housing 30.

As shown in FIG. 1, the housing base 72 is provided with the pair of elastic fasteners 74 on both outer sides in the lateral direction of the engagement portion 73, the lateral direction, as indicated by arrow X, being perpendicular to the engagement direction. Each of the elastic fasteners 74 is formed so as to protrude upwards from the top surface of the housing base 72, and is provided with a locking protrusion 74*a* on an inner side of the tip end thereof as shown in FIG. 6B and FIG. 9B. When the receptacle connector 10 is engaged with the header connector 70, the elastic fasteners 74 are caused to flex outward in the lateral direction by the fastening sections 51, so that the locking protrusions 74*a* lock in the fastener receiving openings 51*a* of the fastening sections 51.

Further, as shown in FIG. 5B, FIG. 8B and FIG. 12, a first annular groove 73*a* is formed around the perimeter of the engagement portion 73. Arranged in the first annular groove 73*a* is a ring-like first seal member 91 that seals a gap between the engagement portion 73 and the base housing 30.

Further, as shown in FIG. 5B and FIG. 8B, a second annular groove 72*a* is formed in a bottom surface of the housing base 72. Arranged in the second annular groove 72*a* is a ring-like second seal member 92 that seals a gap between the bottom surface of the housing base 72 and the casing 100.

Next, a method for assembling the receptacle connector 10, a method for engaging the assembled receptacle connector 10 with the header connector 70, and a method for disengaging the receptacle connector 10 from the header connector 70 will be described with reference to FIGS. 1 to 10.

First, when assembling the receptacle connector 10, the tip end of the cable C is passed through the inner side through-holes of the water-resistant rubber seal pressing member 44 and the water-resistant rubber seal 43, and inserted via the cable receiving passageway 32 into the base housing 30 to which the fasteners 50 and the lock 60 are attached.

Next, each electrical wire of the cable C is connected by crimping with the barrel portion 42 of each receptacle contact 40.

Thereafter, the receptacle contacts 40 are inserted into the contact housing chambers 22 of the contact housing 21. Accordingly, the receptacle contacts 40 are locked by the housing lances 23 of the contact housing 21 and are thereby secured in the contact housing 21. Then, the contact housing 21 is inserted through the opening in the base housing 30 and into the contact receiving space 31.

Further, by screwing the water-resistant rubber seal pressing member 44 onto the cylindrical portion 33, the water-resistant rubber seal 43 is caused to press hard on the cable C from the outer circumferential side of the cable C. As a result, the cable C is connected at the end of the receptacle connector 10 in a state in which the space between the water-resistant rubber seal 43 and the cable C is sealed. This completes the assembly of the receptacle connector 10.

Here, since the contact housing 21 that houses the receptacle contacts 40 is configured as a separate body from the base housing 30, the receptacle contacts 40 to which the electrical wires are connected can be easily attached to the connector housing 20.

When the assembled receptacle connector 10 is engaged with the header connector 70, the lock 60 is moved from a front side to a back side so as to be located in the second position shown in FIG. 1. As shown in FIG. 6A, when the lock 60 is in the second position, the locking protrusion 46 of the base housing 30 is located to the front side of the second locking protrusion 65*b* of each locking arm 65. Further, as shown in FIG. 6B and FIG. 7B, when the lock 60 is in the second position, the thick plate portion 64 of the lock 60 contacts the inner surface 51*b* of the fastening section 51, thus supporting the fastener 50.

As shown in FIG. 2 and FIGS. 5 to 7, the receptacle connector 10 is moved downwards in the engagement direction indicated by arrow M, causing the contact housing 21 and the base housing 30 to engage with the engagement portion 73 of the header connector 70. Hence, the receptacle contacts 40 make contact with the header contacts 80, electrically connecting the cable C with the header contacts 80.

Here, when the receptacle connector 10 is engaged with the header connector 70, the elastic fastener 74 of the header connector 70 is locked to the fastening sections 51 of the fasteners 50 provided on the receptacle connector 10, locking together the two connectors 70. Specifically, when the receptacle connector 10 is engaged with the header connector 70, the elastic fasteners 74 are caused to flex outward in the lateral direction by the fastening sections 51, so that the fastening sections 51 flex inward. Then, the locking protrusions 74*a* of the elastic fasteners 74 lock in the fastener receiving openings 51*a* of the fastening sections 51, locking together the two connectors 10 and 70.

Thus, it is possible to lock together the two connectors 10 and 70 by simply engaging the receptacle connector 10 and the header connector 70. The connectors 10 and 70 can therefore be locked together with a simple operation, and there is no need to secure the receptacle connector 10 to the header connector 70 using screw fasteners or the like.

Further, as described above, when the receptacle connector 10 and the header connector 70 are locked together, the lock 60 is in the second position and supports the fastener 50 on the inner side of the fastening section 51 of the fastener 50. As a result, after the elastic fasteners 74 of the header connector 70 have been locked with the fastening sections 51 of the fasteners 50, inward movement of the fasteners 50 can be restricted, thus enhancing lock robustness.

Further, when the receptacle connector 10 is engaged with the header connector 70, the first ring-like seal member 91 arranged around the perimeter of the engagement portion 73 is compressed inwardly in the lateral direction by the base housing 30. As a result, the space between the base housing 30 and the engagement portion 73 is sealed. The force reacting to compression of the first seal member 91 in the lateral direction presses the receptacle connector 10 including the base housing 30 outwardly in the lateral direction, thus reinforcing the locking strength of the fasteners 50 and the elastic fasteners 74.

Figure 3:
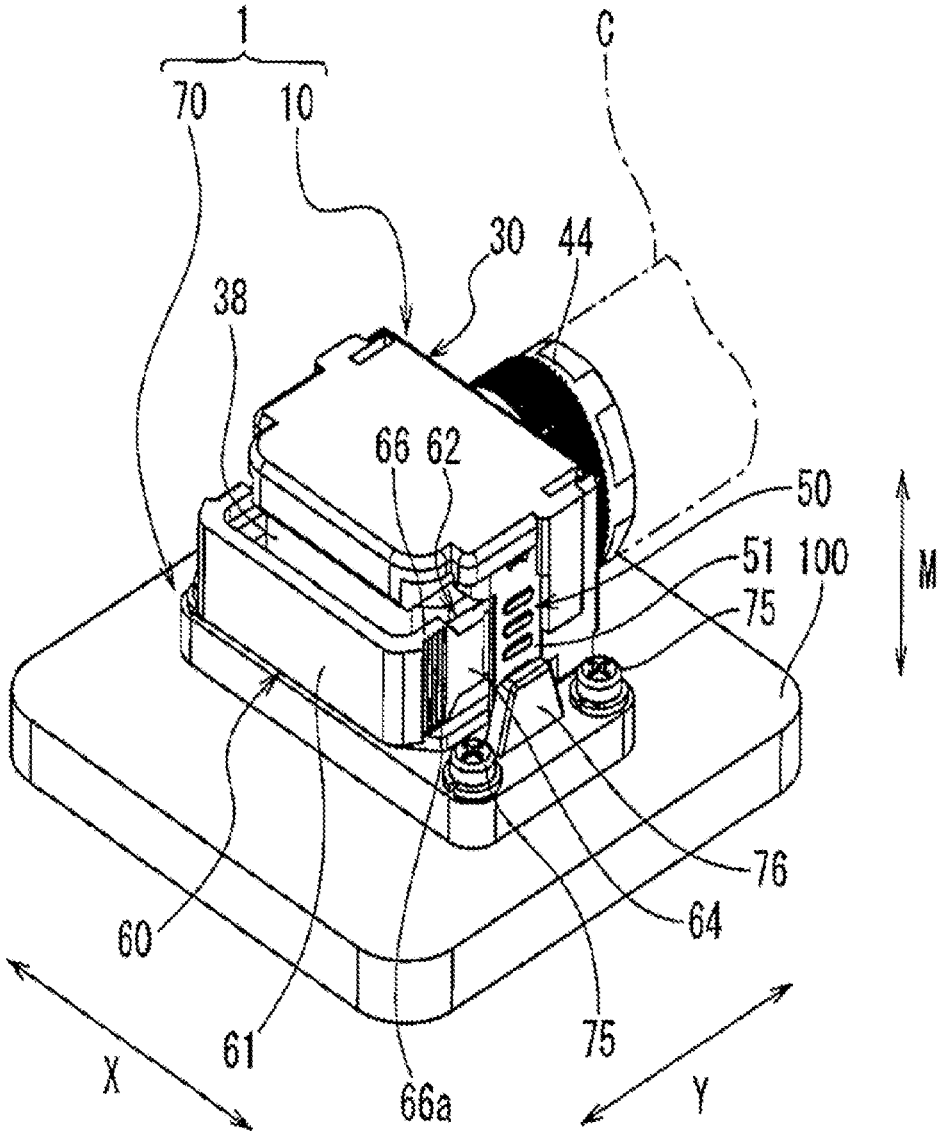
FIG. 3 is a perspective view of the connector assembly of FIG. 2 showing a lock.

As shown in FIG. 3, when the receptacle connector 10 is disengaged from the header connector 70, the lock 60 is moved from the back side to the front side so as to be located in the first position. As shown in FIG. 9A, when the lock 60 is in the first position, the locking protrusion 46 of the base housing 30 is located between the first locking protrusion 65*a* and the second locking protrusion 65*b* of each locking arm 65. Hence, even when an external force is applied to the lock 60 such as in an attempt to release the lock 60 from the base housing 30, the lock 60 does not move from the first position. Further, as shown in FIG. 9B and FIG. 10B, when the lock 60 is in the first position, the thin plate portion 63 and locking arms 65 of the lock 60 form a predetermined gap with the inner surfaces 51*b* of the fastening sections 51.

The fastening sections 51 of the pair of fasteners 50 provided in the receptacle connector 10 are then pressed from outward to inward in the lateral direction, and the locking protrusions 74*a* of the elastic fasteners 74 are released from the fastener receiving openings 51*a* of the fastening sections 51. Here, the fastening sections 51 are able to move inwardly because of the predetermined gap formed by the thin plate portion 63 and the locking arms 65 with the inner surfaces 51*b* of the fastening sections 51. As described above, when the lock 60 is in the second position, the thick plate portion 64 contacts the inner surfaces 51*b* of the fastening section 51, thus supporting the fasteners 50. Hence, the fastening sections 51 are unable to move inward.

Figure 4:
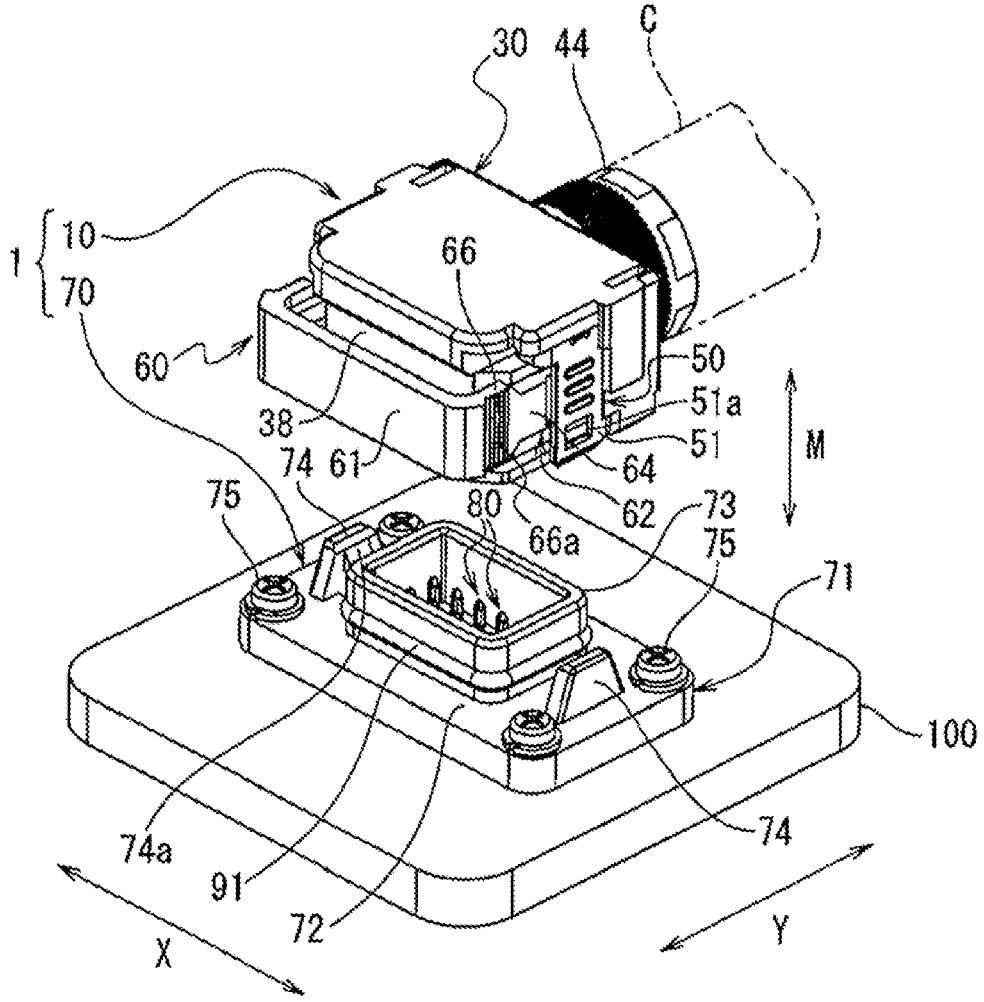
FIG. 4 is a perspective view of the connector assembly of FIG. 3 showing the receptacle connector disengaged from the header connector.

As shown in FIG. 4, as the elastic fasteners 74 are released from being locked to the fastening sections 51, the receptacle connector 10 is moved upward along the engagement direction indicated by arrow M. As a result, the engagement state of the contact housing 21 and the base housing 30 with the engagement portion 73 of the header connector 70 is released. Accordingly, the receptacle contacts 40 are separated from the header contacts 80, disconnecting the cable C from the header contacts 80.

Thus, when disengaging the receptacle connector 10 from the header connector 70, it is sufficient to release the locking state of the elastic fasteners 74 with the fastening sections 51 to unlock the two connectors 10 and 70. Hence, it is possible to release the locking of the two connectors 10 and 70 with a simple operation.

In addition, in the connector assembly 1 of the present embodiment, the fasteners 50 are secured at the outer end portions in the lateral direction, which is perpendicular to the engagement direction, of the base housing 30 without a coil spring or cam groove being needed to lock the two connectors 10 and 70 as is conventionally the case. Also, the elastic fastener 74 is provided at the outer side in the lateral direction, which is perpendicular to the engagement direction, of the engagement portion 73 of the header housing 71, and flexes outwards in the lateral direction to lock with the fastening section 51 of the fasteners 50. Hence, it is possible to form a connector assembly 1 having low-profile structure in which the engagement direction height is reduced.

Further, since the lock 60 is attached to the base housing 30 so as to be movable in a front-back direction that is perpendicular to both the engagement direction and the lateral direction, it is possible to form a connector assembly 1 with a low-profile structure in which the engagement direction height is reduced.

Further, the lock 60 includes a support plate portion 62 that enters between the outer surface 38*a* of the base housing 30 and the inner surface 51*b* of the fastening section 51. Also, the support plate portion 62 includes, at a back side thereof, a thin plate portion 63 that forms a predetermined gap with the inner surface 51*b* of the fastening section 51 when the support plate portion 62 is in the first position, and includes, to the front side of the thin plate portion 63, a thick plate portion 64 that contacts the inner surface 51*b* of the fastening section 51 to support the fastener 50 when the support plate portion 62 is in the second position. Thus, the lock 60 with a simple configuration can be realized such that the fastener 50 is in an unsupported state when in the first position, and supports the fastener 50 on the inner side of the fastening section 51 of the fastener 50 when in the second position.

In addition, the lock 60 includes the pair of locking arms 65 that extend backwards from the thin plate portion 63. Further, the first locking protrusion 65*a* is provided at the back edge of each locking arm 65, and the second locking protrusion 65*b* is provided at the front side of the first locking protrusion 65*a*. When the locking protrusion 46 is located between the first locking protrusion 65*a* and the second locking protrusion 65*b*, the lock 60 is in the first position. Further, when the locking protrusion 46 is located to the front side of the second locking protrusion 65*b* of each locking arm 65, the lock 60 is in the second position. Hence, the lock 60 can be reliably positioned in the first position and the second position.

Further, the lock 60 is provided with the left-right pair of grip portions 66 with serrations 66*a* formed on the outer surface thereof, between both outer end portions in the lateral direction of the connecting plate portion 61 and the pair of support plate portions 62. Hence, when the lock 60 is moved from the first position to the second position and from the second position to the first position, the operator can move the lock 60 easily by holding the grip portions 66.

The above has described an embodiment of the present invention, but the present invention is not limited to this and can be modified and improved in various ways.

For example, although the connector housing 20 was configured from the contact housing 21 housing the receptacle contact 40 and the base housing 30, the contact housing 21 and base housing 30 may house the receptacle contact 40 as a single unit.

Moreover, the fastener 50 need not be provided in a pair, and may instead be provided singly at an outer end portion in the lateral direction of the base housing 30 (connector housing 20). Accordingly, the elastic fastener need not be provided in a pair, and may instead be provided singly outward in the lateral direction of the engagement portion 73 of the header housing 71.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A connector assembly, comprising:

a receptacle connector having:

a connector housing with a receptacle contact;

a fastener with a fastening section fixed at an outer end portion thereof; and a lock attached to the connector housing and movable in a lateral direction between a first position and a second position along a length thereof; and a header connector having:

a header contact connectable with the receptacle contact;

a header housing engageable with the connector housing and having an engagement portion to which the header contact is attached; and an elastic fastener extending outward from the engagement portion of the header housing, the elastic fastener engaging and deflecting the fastening section when the receptacle connector is moved in an engagement direction perpendicular to the lateral direction toward the header connector, the lock preventing deflection of the fastening section in the second position.

2. The connector assembly according to claim 1, wherein the lock includes a pair of support plate portions extending parallel from outer end portions thereof.

3. The connector assembly according to claim 2, wherein each support plate portion of the pair of support plate portions includes a thin plate portion positioned along a back side thereof to form a predetermined gap with an inner surface of the fastening section.

4. The connector assembly according to claim 3, wherein the lock includes a pair of vertical locking arms extending backward from the thin plate portion.

5. The connector assembly according to claim 4, wherein each locking arm of the pair of vertical locking arms includes a first locking protrusion positioned along at a back edge thereof and a second locking protrusion provided along a front side of the first locking protrusion.

6. The connector assembly according to claim 5, wherein the lock includes a pair of grip portions with serrations formed on an outer surface thereof.

7. A connector assembly, comprising:

a receptacle connector having:

a connector housing with a receptacle contact;

a fastener with a fastening section fixed at an outer end portion thereof; and a lock attached to the connector housing and movable along a length thereof, the lock including a pair of support plate portions extending parallel from outer end portions thereof, each support plate portion of the pair of support plate portions including a thin plate portion positioned along a back side thereof to form a predetermined gap with an inner surface of the fastening section, and a pair of vertical locking arms extending backward from the thin plate portion, each locking arm of the pair of vertical locking arms including a first locking protrusion positioned along at a back edge thereof and a second locking protrusion provided along a front side of the first locking protrusion; and a header connector engageable with the receptacle connector, and having:

a header contact connectable with the receptacle contact;

a header housing engageable with the connector housing and having an engagement portion to which the header contact is attached; and an elastic fastener extending outward from the engagement portion of the header housing.

8. The connector assembly according to claim 7, wherein the lock includes a pair of grip portions with serrations formed on an outer surface thereof.

* * * * *